United States Patent [19]

Owen et al.

[11] 4,090,949

[45] May 23, 1978

[54] UPGRADING OF OLEFINIC GASOLINE WITH HYDROGEN CONTRIBUTORS

[75] Inventors: Hartley Owen, Belle Mead; Paul B. Venuto, Cherry Hill, both of N.J.

[73] Assignee: Mobil Oil Corportion, New York, N.Y.

[21] Appl. No.: 738,913

[22] Filed: Nov. 4, 1976

Related U.S. Application Data

[63] Continuation of Ser. No. 493,300, Jul. 31, 1974, abandoned.

[51] Int. Cl.[2] ..... C07C 15/02; B01J 8/24; C01B 29/12

[52] U.S. Cl. ..... 208/78; 208/102; 208/120; 260/668 R; 260/673

[58] Field of Search ..... 208/78, 120

[56] References Cited

U.S. PATENT DOCUMENTS

| | | | |
|---|---|---|---|
| 3,533,936 | 10/1970 | Weisz | 208/56 |
| 3,758,403 | 9/1973 | Rosinski et al. | 208/120 |
| 3,760,024 | 9/1973 | Cattanach | 260/673 |
| 3,770,614 | 11/1973 | Graven | 208/62 |
| 3,812,199 | 5/1974 | Chen et al. | 260/676 R |
| 3,847,793 | 11/1974 | Schwartz et al. | 208/70 |
| 3,849,291 | 11/1974 | Owen | 208/78 |
| 3,965,205 | 6/1976 | Garwood et al. | 260/668 R |

*Primary Examiner*—Delbert E. Gantz
*Assistant Examiner*—G. E. Schmitkons
*Attorney, Agent, or Firm*—Charles A. Huggett; Carl D. Farnsworth

[57] ABSTRACT

A method for upgrading poor quality olefinic gasoline by conversion thereof in the presence of carbon hydrogen-contributing fragments such as methanol and a crystalline zeolite catalyst composition of desired selectivity characteristics is described.

10 Claims, 1 Drawing Figure

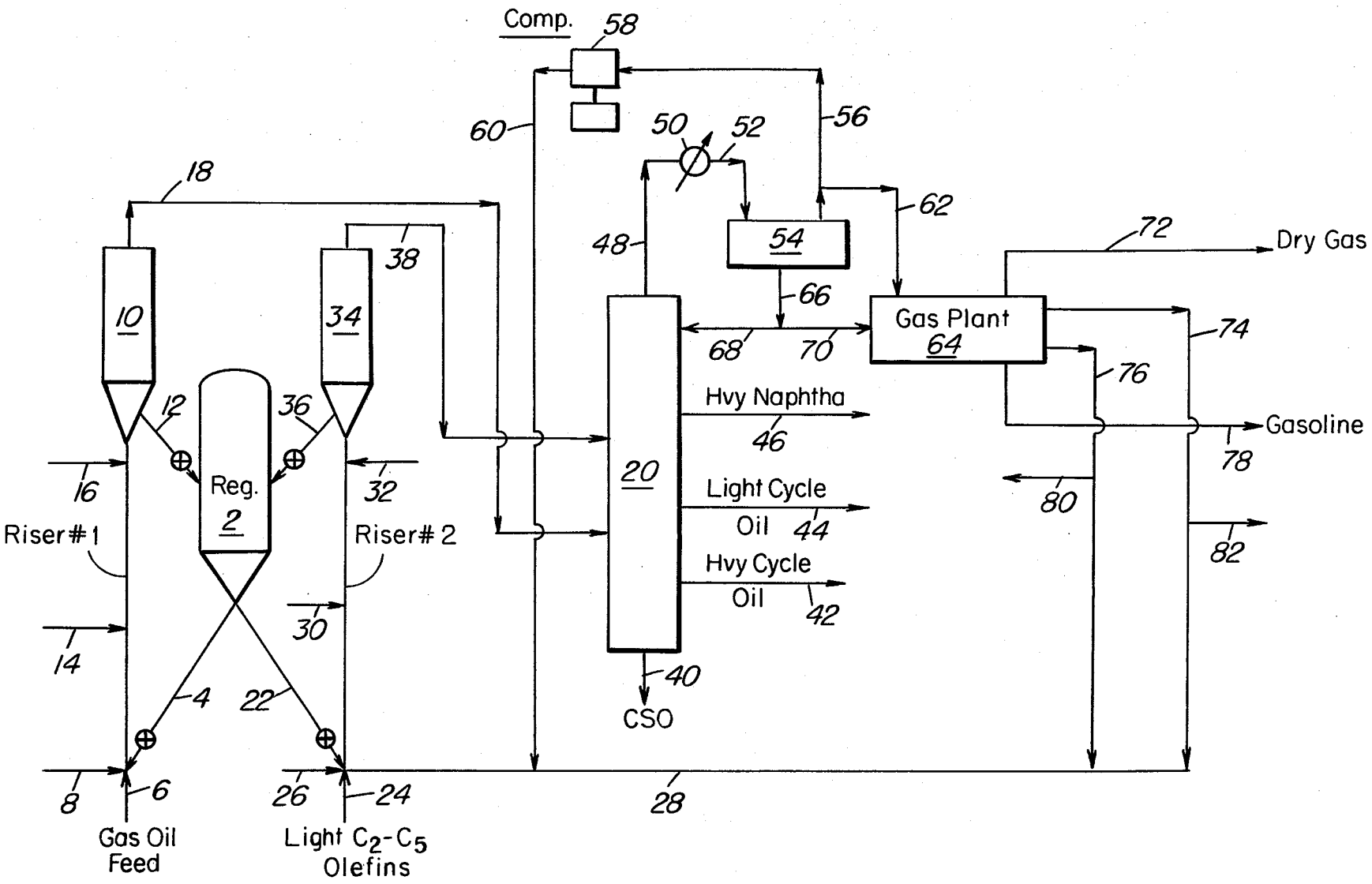
Dry Gas
Gasoline
Gas Plant
64
Hvy Naphtha
Light Cycle
Oil
Hvy Cycle
Oil
CSO
Comp.
Reg.
2
Riser # 2
Riser # 1
Light $C_2$-$C_5$
Olefins
Gas Oil
Feed
10
20
28
34
38
40
42
44
46
48
50
52
54
56
58
60
62
66
68
70
72
74
76
78
80
82
4
6
8
12
14
16
18
22
24
26
30
32
36

UPGRADING OF OLEFINIC GASOLINE WITH HYDROGEN CONTRIBUTORS

RELATED APPLICATIONS

This application is a Continuation of Ser. No. 493,300, filed July 31, 1974, and now abandoned.

BACKGROUND OF THE INVENTION

There is a continuing demand for petroleumderived fuel products and particularly high octane gasoline and high quality light distillate products. The impending fossil fuel shortage however, has aggravated the demand requirements thereby forcing the refiner to look for other ways of providing the necessary products. In their efforts to optimize gasoline production, for example, refiners have been forced to use increasingly lower quality, heavier, more refractory charge materials resulting in the formation of gasoline boiling range fractions (such as coker naphtha) that are poor in quality (low octane) and high in impurities such as sulfur and/or oxygen.

SUMMARY OF THE INVENTION

The present invention is concerned with upgrading relatively poor quality olefinic gasoline, for example, by conversion thereof in the presence of hydrogen and/or carbon hydrogen contributing fragments and an acid function catalyst comprising a crystalline zeolite of selected pore characteristics.

More particularly, upgrading of relatively poor quality gasoline or gasoline boiling range material is accomplished with $C_5$ minus contributors of active or nascent hydrogen and/or carbon hydrogen fragments to obtain high yields of quality gasoline products by contact with one or more crystalline zeolites of desired characteristics. The quality benefits may include one or more of higher octane number, lower sulfur level and improved volatility. In some cases, small amounts of high quality distillate fuels are produced.

By gasoline boiling range material is meant any hydrocarbon or petroleum type material boiling in the naphtha or gasoline boiling range (75° to about 440° F.) and includes hydrocarbons in the range of $C_5$ to $C_{12}$ carbon number materials. Although any gasoline boiling range material is suitable for processing according to this invention, highly olefinic naphthas such as heavy catalytic naphthas, coker naphthas and low naphthene material not desirable as a reforming charge material may be upgraded by the combination operation of this invention.

By low molecular weight hydrogen contributor is meant a material with a carbon number less than that of gasoline boiling range material and providing under selected conversion conditions, mobile hydrogen and/or carbon hydrogen fragments of conversion. The hydrogen contributor is preferably a $C_5$ or less carbon atom material and may be selected from the group comprising olefinic gases, alcohols and ethers. Others materials which may be used successfully include acetals, aldehydes, ketones, mercaptans, aliphatic thioethers, methylamines, quaternary ammonium compounds and haloalkanes such as methyl chloride. Also materials that chemically combine to generate active and nascent hydrogen such as carbon monoxide alone or especially its combination with either of hydrogen, water, alcohol or an olefin may be employed. A catalyst with a hydrogen-activating function is preferred when carbon monoxide is a part of the hydrocarbon conversion feed. The preferred hydrogen contributing agents are methanol and $C_2$–$C_5$ olefins.

By catalyst with an acid function and selected pore characteristics is meant an acidic composition, preferably a crystalline alumino-silicate or a crystalline zeolite material supported by a relatively inert matrix material or intermittently dispersed in one of relatively low catalytic activity and comprising amorphous silica-alumina material. Preferred catalyst compositions include one or more crystalline zeolites of similar pore size configuration and distribution but differing in crystalline structure. Crystalline zeolites which may be used with preference include ZSM-5 crystalline zeolite and ZSM-5 type crystalline zeolite, mordenite and mordenite type crystalline zeolite (dealuminized mordenite) with and without the presence of a faujasite type of crystalline zeolite (X and Y type). The catalyst may be provided with a metal component known as a hydrogen activating function which aids in the distribution or transfer of provided mobile hydrogen. The metal function may be selected from the group comprising Pt, Ni, Fe, Re, W, Mo, Co, Th, Cr, Ru V or Cu. Catalyst functions known in the art to catalyze the Fischer-Tropsch reaction, the water gas shift reaction, and olefin disproportion may be particularly preferred.

In the processing combination of the present invention, poor quality, low octane naphthas or gasoline boiling range materials are upgraded in a catalytic system of relatively low pressure usually less than 200 psig and more usually less than 100 psig. The catalytic system employed may be either fluid, moving bed or a fixed bed system, it being preferred to employ a fluid catalyst system. Use of a fluid system maximizes facile intermolecular hydrogen-transfer reactions and minimizes problems due to diffusion limitations and/or heat transfer.

The method and system of the present invention takes advantage of available and relatively cheap low molecular weight refinery product olefin fractions thereby reducing the need for alkylation capacity and/or system for purifying the alkylation olefinic feed. This is obviously particularly attractive where isobutane is in short supply or expensive, if not very expensive. The concept of this invention also makes use of low boiling alcohols and ethers and particularly methanol. Methanol is relatively easily obtained and is expected to be available in quantity either as a product of foreign natural gas conversion or as a product of coal, shale or tar sands gasification. Similarly, carbo monoxide which may be used in the combination is a readily available product of catalyst regeneration flue gas or from coal, shale and tar sand gasification or partial combustion processes.

As mentioned above, the process of this invention is preferably practiced in a fluid system of either dispersed phase risers, dense fluid catalyst beds or a combination thereof. It can also be practiced in fixed and moving bed operation with considerable success. Also single and multiple stage operations may be employed. The processing combination of the present invention may include:

1. A dual riser operation with different conditions and/or catalyst.
2. Cascade and recycle of used catalyst to regulate catalyst to oil ratio and/or catalyst/activity — selectivity characteristics.
3. Multiple injection of $C_5^-$ hydrogen contributor at spaced apart intervals along a riser reactor.

4. Recycle of unreacted low boiling olefinic gases and other $C_5$ carbon-hydrogen contributors providing mobile hydrogen in the operation.

In a particular aspect the present invention relates to the upgrading of low quality gasoline with a $C_5$ minus material selected from the group consisting of alcohols, ethers and olefin rich gases by contact with at least a ZSM-5 type crystalline zeolite conversion catalyst. The upgrading operation may be effected at temperatures selected from within the range of 500° to 1100° F., a pressure within the range of 20 to 75 psig and a catalyst to oil ratio selected from within the range of 2 to 100. Relatively high (5 to 30) catalyst to oil ratios are generally preferred and it is preferred that the ratio of $C_5$ minus material to olefinic gasoline be retained within the range of 0.1 to 1.0 weight ratio.

BRIEF DESCRIPTION OF THE DRAWING

The drawing is a diagrammatic sketch in elevation of a dual riser conversion operation and product separation operation for practicing the process of the present invention.

DISCUSSION OF SPECIFIC EMBODIMENTS

EXAMPLE 1

An FCC gasoline providing the following inspections was used in the example. API gravity (60° F), 52.3; molecular weight, 107; boiling range at 167° F. (10%) - 396° F. (90%). It showed a 85.7 (R+O) octane (raw), and gave the following ($C_6$+) component analysis by mass spectroscopy:

| | Vol. % | |
|---|---|---|
| Paraffins | 28.7 | |
| Olefins | 35.8 | (highly olefinic) |
| Naphthenes | 14.1 | |
| Aromatics | 21.4 | |
| Molecular Wt. | 106.6 | |
| Wt. % Hydrogen | 13.42 | |

In run A an olefinic material, Cis-2-butene (35.1 wt.% based on gasoline) and an FCC gasoline of the above inspection were pumped from separate reservoirs to the inlet of feed preheater of a 30 ft. bench-scale riser fluid catalytic cracking (FCC) unit. The feed stocks were intimately mixed in the feed preheater at a temperature of about 500°-525° F. and then admitted to the riser inlet where they contacted hot (1166° F) catalyst, 2% REY - 10% H-mordenite, burned white, 38.6 FAI). The riser reactor inlet mix temperature was about 1000° F. ratio of catalyst to oil (gasoline + butene) was 5.9 (wt./wt.) and the catalyst residence time in the riser was about 3 seconds. The riser inlet pressure was 30 psig, and the ratio of catalyst residence time to oil residence time was 1.24. The riser effluent was then passed through a steam-stripping chamber, and a gaseous effluent was separated from the suspended catalyst (0.063 wt.% carbon). The gaseous and liquid products were collected, separated by distillation and analyzed. Data for the reaction conditions, product selectivities, gasoline inspections, and cycle oil inspections are shown in Tables 1, 2, 3 and 4, respectively.

A control run A was made with the above identified gasoline only, (no cis - 2 - butene present).

The analytical results show that when the olefinic gasoline is cracked in the presence of the $C_4$-olefin, slightly higher yields of $C_5$+ gasoline are obtained. Also the gasoline shows a higher octane number (R+O = 92.5) than that obtained without the presence of the $C_4$ minus olefin (R+O = 87.8), a (R+O) of + 4.7 units. Upon correcting the data to a $C_5$+ basis, the Δ(R+O) is + 1.4 units. In addition, less than 1 wt.% of total feed was converted to coke, and about 8.5 wt.% of the light fuel oil (500° F. at 50% point), 16.5° API, 9.37 wt.% hydrogen was produced. A large amount (39.3 wt.% of total product) of butene can be recycled for further conversion if desired.

Table 1

Reaction of Olefinic FCC Gasoline With Cis-2-Butene Over Zeolite Catalyst

| Run | Reaction Conditions A | B |
|---|---|---|
| Reactor Inlet Temp., ° F. | 1000 | 1000 |
| Gasoline Feed Temp., ° F. | 500 | 525 |
| Catalyst Inlet Temp., ° F. | 1170 | 1166 |
| Catalyst/Oil (wt/wt) Ratio | 6.61 | 5.90[a] |
| Catalyst Residence Time, Sec. | 3.42 | 3.02 |
| Reactor Inlet Pressure, PSIG | 30.0 | 30.0 |
| Carbon, Spent Catalyst, % wt. | .054 | .063 |
| Slip Ratio | 1.24 | 1.24 |
| Cis-2-Butene, wt.% of Gasoline | none | 35.1 |
| Molar Ratio, Cis-2-Butene/Gasoline | 0 | 0.67 |
| Catalyst | ← 2% REY + 10% Mordenite → in matrix, FAI = 38.6 | |

[a]Based on Cis-2-Butene + Gasoline

Table 2

Product Selectivities (Basis: 100 g gasoline feed)

| Run | A | B |
|---|---|---|
| Charge In | | |
| Gasoline, g | 100.0 | 100.0 |
| Cis-2-Butene, g | — | 35.1 |
| Total, g | 100.0 | 135.1 |
| Products Out, g | | |
| $C_5$+-Gasoline[a] | 80.61 | 82.23[b] |
| Total $C_4$ | 7.76 | 39.30 |
| Dry Gas | 3.99 | 4.36 |
| Coke | 0.39 | .74 |
| Cycle Oil | 7.29 | 8.46 |
| Light Product Breakdown, g | | |
| $H_2S$ | 0.00 | .03 |
| $H_2$ | 0.02 | .03 |
| $C_1$ | 0.26 | .26 |
| $C_2$= | 0.28 | .36 |
| $C_2$ | 0.18 | .16 |
| $C_3$= | 2.76 | 3.08 |
| $C_3$ | 0.48 | .45 |
| $C_4$= | 5.22 | 36.04 |
| i-$C_4$ | 2.28 | 2.20 |
| n-$C_4$ | 0.26 | 1.05 |
| $C_5$= | 5.25 | 5.81 |
| i-$C_5$ | 3.45 | 3.01 |
| n-$C_5$ | 0.68 | 0.53 |
| Recovery, wt.% of Feed | 93.7 | 95.0 (adj.) |
| $H_2$ Factor | 34 | 39 |

[a]~ 356° F. at 90% cut point

[b]Corrected for ~ 3 wt.% gasoline in cycle oil.

Table 3

Gasoline Inspections

| Run | A | B |
|---|---|---|
| API Grav., 60° F | 54.8 | 59.8 |
| Sp. Grav., 60° F | .7597 | .7398 |
| R+O Octane Number, Raw | 87.8 | 92.5 |
| R+O Octane Number, $C_5$+ | 88.7 | 90.1 |
| Hydrocarbon Type, $C_5$-Free, Vol.% | | |
| Paraffins | 37.4 | 34.4 |
| Olefins | 10.1 | 12.4 |
| Naphthenes | 16.5 | 15.6 |
| Aromatics | 36.0 | 37.4 |
| % H | 12.93 | 12.82 |
| MW | 109.39 | 110.17 |

Table 4

| Cycle Oil Inspections | | |
|---|---|---|
| Run | A | B |
| Sp. Grav., 60° F. | .9772 | .9563 |
| API Grav., 60° F. | 13.30 | 16.47 |
| Hydrogen, % Wt. | 8.91 | 9.37 |
| Hydrocarbon Type, Wt. % | | |
| Paraffins | — | 7.3 |
| Mono-naphthenes | — | 2.1 |
| Poly-naphthenes | — | 0.7 |
| Aromatics | — | 90.7 |
| Distillation, ° F. | | |
| 10% | 424 | 405 |
| 50% | 510 | 500 |
| 90% | 766 | 939 |

EXAMPLE 2

Methanol (16.4 wt% based on gasoline) and the above identified FCC gasoline were pumped from separate reservoirs to the inlet of the feed preheater of a 30 ft. bench-scale riser FCC unit. Stocks were intimately mixed in the feed preheater at 510° F, and then admitted to the riser inlet where hot (1180° F) catalyst, 2% REY - 10% ZSM-5, burned white, 48.5 FAI) was admitted and catalytic conversion allowed to occur. Riser reactor inlet and mix temperature were 1000° F, ratio of catalyst to oil (gasoline + methanol was 7.2 (wt./wt.), catalyst residence time was about 3.5 inches, riser inlet pressure was 30 psig, and ratio of catalyst residence time to oil residence time was 1.23. Riser effluent was then passed through a steam-stripping chamber, and gaseous effluent was separated from spent catalyst (0.093 wt.% carbon) and the gaseous and liquid products collected, separated by distillation and analyzed. This is run H-649. Data for the reaction conditions, product selectivities, gasoline inspections, and cycle oil inspections are shown in Tables 5, 6, 7 and 8 respectively.

Table 5

| Reaction of Olefinic FCC Gasoline With Methanol - Over Zeolite Catalyst | | |
|---|---|---|
| Reaction Conditions | | |
| | H-648 | H-649 |
| Reactor Inlet Temp., ° F. | 1000 | 1000 |
| Gasoline Feed Temp., ° F. | 510 | 510 |
| Catalyst Inlet Temp., ° F. | 1194 | 1180 |
| Catalyst/Oil (wt/wt) Ratio | 6.54 | 7.18 |
| Catalyst Residence Time, Sec. | 3.46 | 3.54[a] |
| Reactor Inlet Pressure, PSIG | 30 | 30 |
| Carbon, Spent Catalyst, % wt. | .064 | .093 |
| Slip Ratio | 1.23 | 1.23 |
| Methanol wt. % of Gasoline | none | 16.4 |
| Molar Ratio, Methanol/Gasoline | 0 | 0.55 |
| Catalyst | 2% REY - 10% ZSM-5 | |

[a]Based on methanol + Gasoline

Table 6

| Product Selectivities (Basis: 100 g gasoline feed) | | | |
|---|---|---|---|
| Run | H-648 | H-649 | |
| Charge In | | | |
| Gasoline, g. | 100.0 | 100.0 | |
| Methanol, g. | — | 7.2[b] | |
| Total, g. | 100.0 | 107.2 | |
| Products Out, g. | | | Δ |
| $C_5$+-Gasoline[a] | 80.71 | 84.52 | +3.81 |
| Total $C_4$ | 8.20 | 7.09 | |
| Dry Gas | 6.37 | 8.91 | |
| Coke | .46 | .87 | |
| Cycle Oil | 4.26 | 5.83 | |
| Light Product Breakdown, g | | | |
| $H_2S$ | .00 | .00 | |
| $H_2$ | .04 | .16 | |
| $C_1$ | .29 | 2.34 | |
| $C_2$= | .48 | .77 | |

Table 6-continued

| Product Selectivities (Basis: 100 g gasoline feed) | | |
|---|---|---|
| Run | H-648 | H-649 |
| $C_2$ | .18 | .39 |
| $C_3$= | 4.93 | 4.46 |
| $C_3$ | .46 | .77 |
| $C_4$= | 5.47 | 5.16 |
| i-$C_4$ | 2.52 | 1.81 |
| n-$C_4$ | .21 | .12 |
| $C_5$= | 3.76 | 4.25 |
| i-$C_5$ | 3.12 | 2.53 |
| n-$C_5$ | .54 | .47 |
| Recovery, wt. % on Feed | 93.93 | 88.80 |
| $H_2$ Factor | 41 | 44 |

[a]356° F. at 90% wt. point
[b]Only 1.9% of $CH_3OH$ unconverted, and only 2.1% converted to $(CH_3)_2O$.

Table 7

| Gasoline Inspections | | | |
|---|---|---|---|
| | H-648 | H-649 | |
| API Grav., 60° F.[a] | 55.5 | 55.2 | |
| Sp. Grav., 60° F.[a] | .7567 | .7587 | Δ |
| R+O Octane No. Raw[a] | 88.2 | 89.8 | + 1.60 |
| R+O Octane No. $C_5$+[b] | 87.2 | 88.9 | + 1.70 |
| Hydrocarbon Type, $C_5$-Free Vol.% | | | |
| Paraffins | 34.6 | 31.9 | |
| Olefins | 7.4 | 11.8 | |
| Naphthenes | 17.1 | 15.2 | |
| Aromatics | 40.9 | 41.1 | |
| % H | 12.62 | 12.62 | |
| MW | 113.76 | 114.48 | |
| Distillation, ° F.[a] | | | |
| 10% | 98 | 97 | |
| 50% | 269 | 244 | |
| 90% | 408 | 383 | |

[a]On Raw Gasoline
[b]Adjusted for $C_5$'s in gas, and $C_4$- in gasoline.

Table 8

| Cycle Oil Inspections | | |
|---|---|---|
| | H-648 | H-649 |
| Sp. Grav., 60° F. | .9828 | .9658 |
| API Grav., 60° F. | 12.5 | 15.0 |
| Hydrogen, % Wt. | — | — |
| Hydrocarbon Type, wt. % | | |
| Paraffins | — | — |
| Mono-naphthenes | — | — |
| Poly-naphthenes | — | — |
| Aromatics | — | — |
| Distillation, ° F. | | |
| 10% | 410 | 413 |
| 50% | 497 | 494 |
| 90% | 682 | 636 |

A similar (control) run was made with the identified charge gasoline only, with no methanol present run (H-648). Analytical results show that when the olefinic gasoline is cracked in the presence of methanol higher yields of $C_5$ gasoline are obtained (Δ=+ 3.81 wt%), and this gasoline product has a higher octane number (R+O = 89.8) than that obtained without the presence of methanol, (R+O = 88.2), a Δ R+O of plus 1.60 units. Upon correction to a $C_5$+ basis, the Δ R+O is plus 1.7 units. In addition, less than 1 wt.% of total feed was converted to coke, and about 5.83 wt.% of light fuel oil (494° F at 50% point), 15.0° API, was produced. Trace amounts of dimethyl ether and unreacted methanol can be recycled for further conversion if desired.

Referring now to the drawing there is shown diagrammatically in elevation a dual riser fluid catalyst system comprising riser No. 1 and riser No. 2 supplied with hot regenerated catalyst from a common regenerator. Under some circumstances it may be preferred to employ different catalysts in each riser, thus requiring separate regeneration systems. For the sake of simplicity, however, a single regenerator is shown in a system using the same catalyst composition such as a ZSM-5 crystalline zeolite material dispersed in a matrix material which is relatively inert or a relatively low catalytically active silica alumina matrix material. A larger pore crystalline zeolite such as "Y" faujasite may be combined with the ZSM-5 crystalline zeolite matrix mixture or the larger pore zeolite may be dispersed on a separate matrix material before admixture with the smaller pore ZSM-5 catalyst. The matrix material is preferably relatively low in catalytic activity.

In the arrangement of the figure as herein described, cracking catalyst of desired particle and pore size is passed from a regeneration zone 2 by conduit 4 to the bottom or lower portion of a riser conversion zone identified as riser No. 1. A gas oil boiling range charge material and/or recycle material such as a light cycle oil, a heavy cycle oil product of the process or a combination thereof and introduced by conduit 6 is admixed with hot regenerated catalyst charged to the lower portion of riser No. 1 by conduit 4 to form a suspension thereof at a temperature of at least 960° F. and more usually at least about 1000° F. In addition a hydrogen contributing material selected from the group herein defined and comprising methanol in a specific example is introduced by conduit 8 to the suspension or it may be first admixed with the gas oil feed before coming in contact with the hot regenerated catalyst. The suspension thus formed of catalyst, hydrocarbon feed and hydrogen contributor is passed upwardly through the riser under velocity conditions providing a hydrocarbon residence time within the range of 1 to 20 seconds before discharge and separation in separator 10. In separator 10, the riser may terminate by discharging directly into a plurality of cyclonic separators on the end of the riser or terminate in substantially an open ended conduit discharging into an enlarged separation zone as taught and described in the prior art. Any suitable method known may be used to separate the suspension. It is preferred to employ cyclonic separation means on the riser discharge however to more rapidly separate and recover a catalyst phase from a vaporous hydrocarbon phase. The separated catalyst phase is collected generally as a bed of catalyst in the lower portion of zone 10 and stripped of entrained hydrocarbons before it is transferred by conduit 12 to regeneration zone 2. Conduits 14 and 16 are provided for adding any one or both of the reactant materials to riser No. 1. The products of the gas oil riser conversion operation are withdrawn from separator vessel 10 by conduit 18 and passed to a fractionation zone 20.

Regenerated catalyst at an elevated temperature up to about 1400° F. is also withdrawn from regenerator 2 for passage by conduit 22 to the bottom lower portion of riser No. 2. A low quality olefinic gasoline such as coker gasoline, thermal gasoline product and straight run gasoline is introduced by conduit 26 to the bottom lower portion of riser No. 2 combine to form a suspension with the hot catalyst introduced by conduit 22. A hydrogen contributor such as methanol or $C_2 - C_5$ olefins is introduced to the riser by conduit 24. Recycle gaseous products of the process such as a methanol rich stream or a light olefin rich stream recovered as more fully discussed below are also passed to the lower portion o riser No. 2 by conduit 28. The suspension thus formed at a temperature in the range of 450° to 900° F. at a catalyst to olefinic gasoline feed ratio in the range of 1 to 40 is then passed upwardly through the riser under conditions to provide a vapor residence time within the range of 1 to 30 seconds. Additional methanol or olefinic $C_2$–$C_5$ material may be added to the riser by conduits 30 and 32.

Riser No. 2 relied upon the upgrade low quality olefinic gasoline with hydrogen contributing gasiform material discharges into a separation zone 34 which may or may not be the same as separator 10. In any event the separation of catalyst from vaporous or gasiform material is rapidly made under conditions desired. The separated catalyst comprising carbonaceous deposits is collected, stripped and then passed by conduit 36 to the regenerator 2. The reaction products of riser No. 2 separated from the catalyst in separator 34 are passed by conduit 38 to frationator 20. In the combination operation of this invention, the gas oil products of conversion are introduced to a relatively low portion of fractionator 20 with the products of olefinic conversion obtained from riser No. 2 being discharged into a more upper portion of fractionator 20.

In fractionation zone 20, the introduced products are separated. A clarified slurry oil is withdrawn from a bottom portion of tower 20 by conduit 40. A heavy cycle oil is withdrawn by conduit 42, a light cycle oil is withdrawn by conduit 44 and a heavy naphtha fraction is withdrawn by conduit 46. Material lower boiling than the heavy naphtha is withdrawn from the tower as by conduit 48, cooled by cooler 50 to a temperature of about 100° F. before passing by conduit 52 to knockout drum 54. In drum 54 a separation is made between vaporous and liquid materials. Vaporous material comprising $C_5$ and lower boiling gases are withdrawn by conduit 56, passed to compressor 58 and recycled by conduit 60 and 28 to the lower portion of riser No. 2 A portion of the vaporous $C_5$ and lower boiling material is passed by conduit 62 to a gas plant 64. Liquid material recovered in drum 54 is withdrawn by conduit 66 and recycled in part as reflux by conduit 68 to tower 20. The remaining portion of the recovered liquid is passed by conduit 70 to gas plant 64.

In gas plant 64 a separation is made of the $C_3$- products and liquid gasoline product passed thereto to permit the recovery of dry gases comprising $C_3$- materials as by conduit 72, a methanol-ether rich stream as by conduit 74, a light olefin rich stream as by conduit 76 and a light gasoline stream by conduit 78. The methanol rich stream 74 and the olefin rich stream 76 may be recycled alone or in combination to riser No. 2 as shown. All or a portion of the light olefin rich stream may be withdrawn by conduit 80 and passed to alkylation. A portion of the methanol rich stream may be withdrawn by conduit 82 and charged to the gas oil riser cracking unit by conduit 8. It is also to be understood that any one of the recovered heavy naphtha, light cycle oil, heavy cycle oil or a combination thereof recovered as by conduits 42, 44 and 46 may be recycled particularly to the gas oil riser cracking unit. On the other hand, the heavy naphtha may be combined with methanol and converted in a separate riser conversion zone with a ZSM-5 crystalline zeolite catalyst. In this combination it may be preferred to effect conversion of methanol or $C_5$- olefins mixed with naphtha in a separate dense fluid catalyst bed conversion zone provided with its own catalyst regeneration system. On the other hand, a fixed bed reactor arrangement may be relied upon for effecting conversion of methanol and naphtha to gasoline boiling products in the presence of a ZSM-5 type crystalline zeolite.

Having thus generally described the method and system of the present invention and discussed specific embodiments in support thereof, it is to be understood that no undue restrictions are to be imposed by reason thereof except as defined by the following claims.

We claim:

1. A method for upgrading poor quality olefinic gasoline including hydrocarbons in the range of $C_5$ to $C_{12}$ carbon number which comprises:

upgrading said olefinic gasoline mixed with a material selected from the group consisting of $C_5$- olefinic gases, alcohols, ketones, ethers and mixtures thereof by contact with mordenite crystalline zeolite conversion catalysts in combination with a zeolite selected from the group consisting of faujasite and ZSM-5 crystalline zeolite; and effecting said contacting at a pressure below 200 psig and a temperature within the range of 500 to 1100° F.

2. The method of claim 1 wherein the mixture of crystalline zeolites comprises a faujasite crystalline zeolite.

3. A method for upgrading low quality gasoline selected from the group consisting of olefinic naphthas, heavy catalytic naphthas, coker naphthas and low naphthene containing materials which comprises, converting said low quality gasoline admixed with a $C_5$ minus material selected from the group consisting of olefinic gases, alcohols, ethers, ketones and their alcohol derivatives and aliphatic mercaptans and their thioether derivatives and combinations thereof to a higher quality gasoline product by contacting modenite in admixture with a ZSM-5 crystalline zeolite at a pressure less than 100 psig and a temperature within the range of 450° to 900° F, and maintaining the ratio of $C_5$ minus material to low quality gasoline charged within the range of 0.1 to 1.0 weight ratio.

4. A method for upgrading hydrocarbons with a mixture of small and larger pore crystalline zeolites comprising mordenite which comprises, passing a gas oil boiling range material in admixture with a hydrogen contributing material in contact with a mixture of small or larger pore crystalline zeolites comprising mordenite to form a suspension thereof at a temperature of at least 960° F, separating said suspension after a hydrocarbon residence time in the range of 1 to 20 seconds into a hydrocarbon phase and a catalyst phase, contacting a low quality olefinic gasoline admixed with a hydrogen contributor material selected from the group consisting of methanol, and $C_2$ to $C_5$ olefins with said catalyst mixture comprising mordenite at a temperature within the range of 450° to 900° F at a vapor residence time within the range of 1 to 30 seconds, separating products of said low quality gasoline upgrading step into a vaporous phase and a catalyst phase, separating the products of the above-recited catalytic upgrading operations into a slurry oil, cycle oils, a heavy naphtha fraction and material lower boiling than said heavy naphtha fraction, separating material lower boiling than said heavy naphtha after cooling to about 100° F into a vaporous fraction comprising $C_5$ and lower boiling material from high boiling liquid material, recycling a portion of said separated $C_5$ and lower boiling material to said low quality gasoline upgrading step, separately recovering a hydrogen contributor stream from the remaining material lower boiling than said heavy naphtha for recycling to said catalytic upgrading operation above described as desired.

5. The method of claim 4 wherein the catalyst employed in said separate upgrading operations is regenerated in a common regeneration zone.

6. The method of claim 4 wherein upgrading of the gas oil feed is accomplished at a temperature of at least 1000° F and the hydrogen contributing material is methanol.

7. The method of claim 4 wherein the low quality gasoline is selected from the group consisting of coker gasoline and thermal gasoline.

8. The method of claim 4 wherein additional methanol or olefinic $C_2 - C_5$ material is added to the olefinic gasoline upgrading suspension passing through a riser conversion zone.

9. The method of claim 4 wherein one or a combination of heavy naphtha, light cycle oil and heavy cycle oil recovered from the products of gas oil conversion is recycled to said gas oil conversion step.

10. The method of claim 4 wherein separated heavy naphtha is combined with methanol and converted with a ZSM-5 crystalline zeolite conversion catalyst in a separate riser conversion zone.

* * * * *

UNITED STATES PATENT AND TRADEMARK OFFICE

CERTIFICATE OF CORRECTION

PATENT NO. : 4,090,949

DATED : May 23, 1978

INVENTOR(S) : HARTLEY OWEN and PAUL B. VENUTO

It is certified that error appears in the above-identified patent and that said Letters Patent are hereby corrected as shown below:

| | |
|---|---|
| Column 1, line 10 | "petroleumderived" should be --petroleum-derived--. |
| Column 1, line 59 | "Others" should be --Other--. |
| Column 6, line 13 Table 6 Contd | Under heading "Run", "Recovery, wt. % on Feed" should be --Recovery, wt. % of Feed--. |
| Column 8, line 7 | "the" should be --to--. |
| Column 8, line 43 | "$C_3$-" should be -- $C_5$- --. |

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*